United States Patent [19]

Warning

[11] 4,417,418

[45] Nov. 29, 1983

[54] AIR POWERED DOOR OPERATOR

[76] Inventor: Norman E. Warning, 5408 Williams St., White Bear Lake, Minn. 55110

[21] Appl. No.: 348,185

[22] Filed: Feb. 12, 1982

[51] Int. Cl.[3] ..... E05F 11/00

[52] U.S. Cl. ..... 49/199; 160/188; 160/189

[58] Field of Search ..... 49/199, 200, 334, 360; 160/188, 189, 193

[56] References Cited

U.S. PATENT DOCUMENTS 666,170 1/1901 Webster ..... 49/360 X 3,160,200 12/1964 McKee et al. ..... 49/200 X 3,940,887 3/1976 Slaybangh ..... 49/334 X 4,102,382 7/1978 Vesbach ..... 160/188

*Primary Examiner*—Kenneth Downey

*Attorney, Agent, or Firm*—Jacobson & Johnson

[57] ABSTRACT

For a system in which an overhead door is raised or lowered by a combination of a cable, spring, drum and torsion bar which is rotated by a chain-driven sprocket, a pair of pneumatic cylinders having elongated rods attached to the cylinder pistons are attached to the sprocket chain to drive the chain to raise and lower the door. Braking and safety features are provided.

4 Claims, 2 Drawing Figures

AIR POWERED DOOR OPERATOR

FIELD OF THE INVENTION

This invention is directed for use in systems for mechanically opening and closing overhead doors. The invention is primarily intended for commercial and industrial use where the doors are likely to be opened and closed often during the course of the day although it can also be utilized in private garages and the like.

DESCRIPTION OF THE PRIOR ART

This invention is intended to be used in conjunction with conventional mechanisms used for operating overhead doors. In general, conventional doors of this nature are operated by a combination of a torsion spring and cable with the cable wound on a drum axially driven by a torsion bar with the bar being rotated by a chain-driven sprocket. It has been the usual practice in the past to drive the chain by an electrical device such as an electrical motor. In some environments the use of electrical devices is undesirable because of possible danger of sparking causing an explosion or fire. It has also been found that with an electric motor to raise and lower an overhead door if the door becomes jammed, the motor will continue driving and will likely unwind the cable between the drum and the door which could be damaging and hazardous to personnel.

SUMMARY OF THE INVENTION

A pair of pneumatic cylinders have elongated rods attached to be driven longitudinally by the pistons in the cylinder chambers. The rods are attached to the ends of the chain which drives the sprocket which in turn rotates the torsion bar for raising and lowering the garage door. Pressurized air is selectively fed to one of the cylinders to move its piston one way or another to move the door up or down and at the same time the other piston is allowed to move freely. Injection of the pressurized air into one end of a cylinder causes its piston to move rapidly toward the other end thereby initially causing the door to move rapidly. Near the end of its stroke the piston is braked so that the door does not impact suddenly at the end of its travel but is brought to a smooth slow stop. In this fashion the door will mostly open and close quite rapidly yet will avoid damaging impact at the end of its travel.

It has been found that with the use of air pressure as the main driving force for the door, if the door is jammed while being closed it is not closing with undue force; therefore, if a person should happen to be standing under the door while it is being closed, there is little or no likelihood of that person being injured. Neither will the cable which is attached to the door become unwound from the drum.

As a further feature, a second length of chain is attached between the cylinder rods through a fixedly mounted pulley which serves to limit the travel of the rod in the unpressurized cylinder when the pressurized air is applied to the other cylinder. Without this feature the inertia of motion of the cylinder rod which is unpressurized would cause it to reach the end of its travel with impact which could be damaging to the equipment or the operator.

DESCRIPTION OF THE PREFERRED EMBODIMENT

Figure 1:
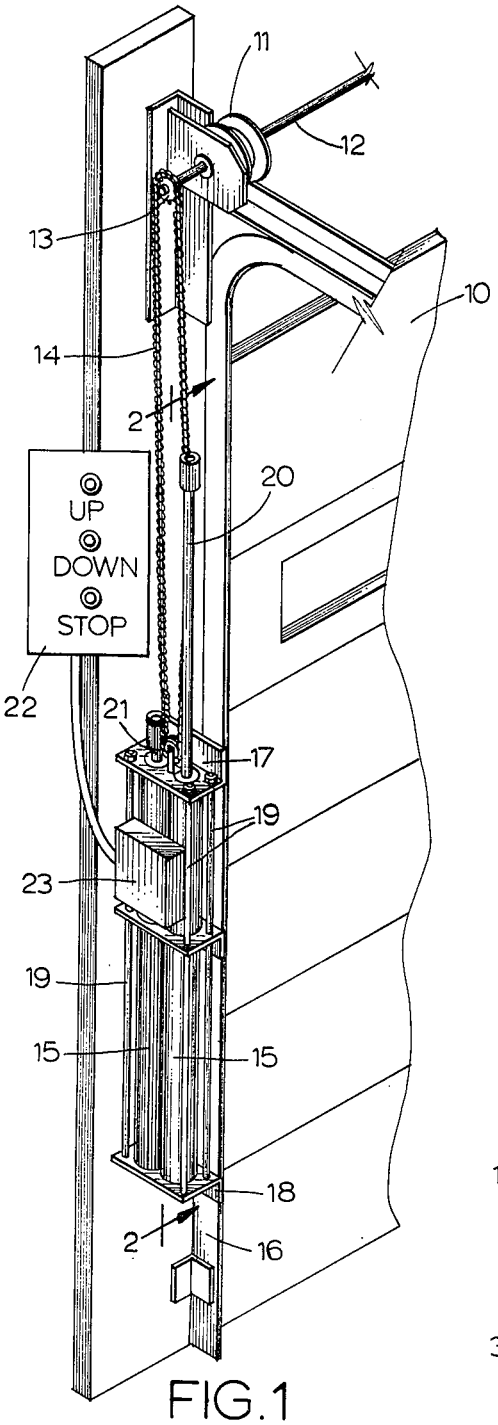
FIG. 1 is a perspective view of a general arrangement of the preferred embodiment of this invention showing the manner in which it is used to operate an overhead door.

In a conventional fashion an overhead door is raised and lowered by a cable and/or spring combination (not shown) with the cable wound on a drum 11 axially mounted on a torsion bar 12 which is rotated by a sprocket 13 driven by a chain 14 linked thereto. The details of this part of the system are not considered important because they do not constitute any part of the invention and are well known and conventional.

A pair of identical elongated cylinders 15 are vertically mounted on a suitable brace 16 in any convenient fashion and are mounted together in any convenient fashion such as by mounting plates 17 and 18 held together by elongated threaded bolts 19. Elongated rods 20 and 21 extending upward from their attachment to the pistons of cylinders 15 are attached to chain 14. While the manner in which the chain is attached to the rods is not critical, typically, it may be by a sleeve or collar over the end of the rod which is held onto the rod by set screws and bolts or pins through the links of the chain secure the chain to the sleeve. A pushbutton electrical control 22 which receives electrical energy from a suitable source, not shown, operates solenoid operated valves 23 which control the feeding of the pressurized air from a suitable air source, not shown, into the cylinders 15. To open the door, "up" button on conttol 22 is pushed which causes pressurized air to be fed into one end of one of the cylinders and opens the other cylinder to atmospheric pressure. The piston in the pressurized cylinder moves to pull chain 14 and rotate torsion bar 12 so that the door opens. To close the door the "down" button in control 22 is pushed, the other cylinder receives pressurized air and the first cylinder is opened to atmosphere and torsion bar 12 is rotated in the opposite direction to bring the door back to its closed position.

Another length of chain 30 is attached at its ends in some convenient fashion to rods 20 and 21 through pulley 31 which is mounted on mounting plate 17. The purpose and function of this arrangement will be described later.

Since the two cylinders 15 are identical in construction, only one will be described and the reference numerals will be common to both. Near their lower ends, as viewed in the FIG. 2, the cylinders are provided with a bleeder opening 32 through the side wall of the cylinder. At the bottom end of the cylinder a check valve 33 and an adjustable needle valve 34 are provided. At the upper end a suitable passageway 35 of conventional design provides communication between the inner chamber of the cylinder 15 and the solenoid valves 23 which are coupled to a suitable pressurized air supply. Since the cylinders are conventional in construction for the most part, no detailed description of their construction is thought to be necessary since one of ordinary skill in the art would readily understand the functional and structural requirements of the cylinder according to the teachings of this invention. Suffice is to point out that suitable bearings, seals and O-rings form part of the construction of the cylinders. The piston assemblies 36 are conventional and operate in the same fashion as ordinary in air operated cylinders. The elongated rods 20 and 21 can be attached to their respective pistons 35 in any convenient fashion.

Figure 2:
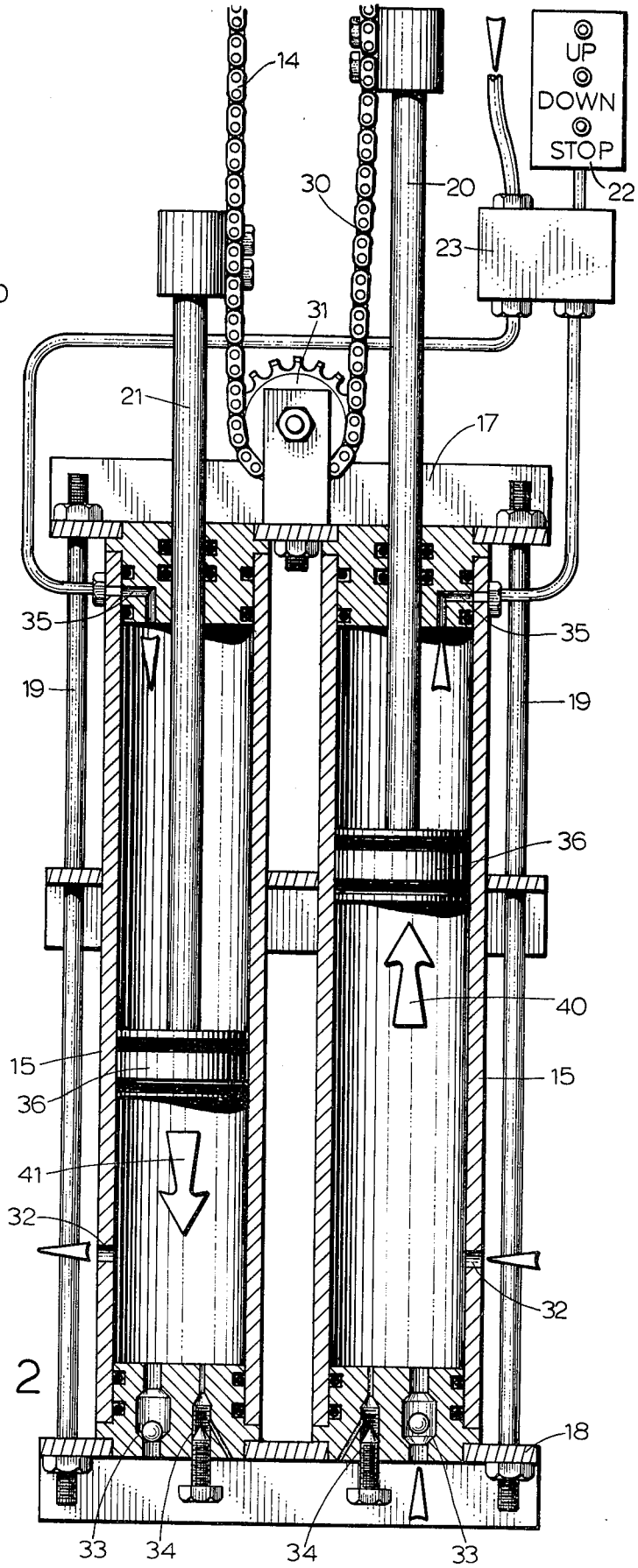
FIG. 2 is a somewhat detailed, partially sectioned diagramatic illustration of the construction and operation of the preferred embodiment.

When pressurized air is fed into one of the cylinder chambers through passageway 35 from valves 23, for example the left-most cylinder shown in FIG. 2, the cylinder chamber in the right-most cylinder is unpressurized. This drives piston 36 downward as indicated by arrow 41, pulling on chain 14 to close or open the door, and at the same time pulling the piston of the rightmost cylinder upward, shown by arrow 40. The smaller arrows show the general air flow. The injection of the pressurized air is such that it causes the piston to drive down rapidly correspondingly causing the other piston to rise rapidly. Because of the momentum of the latter, it could strike the top of the cylinder with great impact. However, chain 30 comes into play to limit the amount of upward travel of the rod and the piston of the unpressurized cylinder.

As the piston in the leftmost cylinder approaches the bottom end it covers the bleeder opening 32 so that the air that is then trapped in the lower part of the cylinder chamber between the piston and the end of the chamber can only leave through the adjustable opening in needle valve 34. Check valve 33 is biased to be opened only when piston 36 is raised, as shown in the rightmost cylinder in FIG. 2. The adjustment in the needle valve 34 is made such that air entrapped at the bottom of the cylinder leaves at a relatively slow rate to brake piston 36 to a slow and smooth end of travel. This is reflected by the door opening or closing in the same fashion. Eventually the piston comes to rest at the end or near the end of the cylinder, but it reaches there in a slow smooth fashion thereby avoiding sudden impacting of the door itself at the end of its travel.

The system has a further feature whereby valves 23 can be operated to allow pressurized air into both the cylinders 15 at the same time. This is done to stop the door at a desired location. It has been found that in the event the door is stopped at an intermediate position, it can be manually pushed open against the force of the air pressure in the cylinders and the weight of the door.

I claim:

1. In a system for operating an overhead door in which the door is raised and lowered by operation of a torsion bar rotated by a chain-driven sprocket, an air-powered operator for driving said chain, comprising:

(a) a pair of air cylinders, each having an internal piston member and an outward extending elongated rod attached at one end to the piston member;

(b) means for attaching the other end of each of said rods to an opposite end of said sprocket chain;

(c) valve means for selectively feeding pressurized air into one end of one of said cylinders to drive the piston toward the other end of the cylinder to raise or lower the door;

(d) an air bleeder opening to atmosphere in each cylinder through the cylinder wall near its other end, said bleeder opening being closed off by the piston when the piston reaches it; and (e) an adjustable needle valve opening to atmosphere in said other end of each cylinder.

2. The invention as described in claim 1 further including:

(a) a fixedly mounted idler pulley;

(e) a second chain attached at each end to said cylinder rods and passing through said idler pulley; and (c) said second chain limiting the travel of the rod of the nonpressurized cylinder when the other cylinder is pressurized causing its rod to move.

3. The invention as described in claim 1 further including a check valve to atmosphere in said other end of each cylinder, said valve biased to open only when the piston member is moving toward said one end.

4. The invention as described in claim 1 further including valve means for selectively feeding pressurized air into both cylinders simultaneously.

* * * * *